US009397386B2

(12) United States Patent
Lin et al.

(10) Patent No.: US 9,397,386 B2
(45) Date of Patent: Jul. 19, 2016

(54) NEAR FIELD COMMUNICATION MODULE

(71) Applicants: Kai-Min Lin, Taipei (TW); Si-Hua Chen, Taipei (TW)

(72) Inventors: Kai-Min Lin, Taipei (TW); Si-Hua Chen, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 195 days.

(21) Appl. No.: 14/260,285

(22) Filed: Apr. 24, 2014

(65) Prior Publication Data

US 2014/0320353 A1 Oct. 30, 2014

Related U.S. Application Data

(60) Provisional application No. 61/817,300, filed on Apr. 29, 2013.

(30) Foreign Application Priority Data

Mar. 27, 2014 (TW) ..... 103111527 A

(51) Int. Cl.

| | |
|---|---|
| ***H01Q 1/24*** | (2006.01) |
| ***H01Q 1/22*** | (2006.01) |
| ***H01Q 21/00*** | (2006.01) |
| ***H01Q 1/38*** | (2006.01) |
| ***H01Q 7/00*** | (2006.01) |

(52) U.S. Cl.

CPC ..... *H01Q 1/2216* (2013.01); *H01Q 1/38* (2013.01); *H01Q 7/00* (2013.01); *H01Q 21/00* (2013.01)

(58) Field of Classification Search

CPC . G06K 7/10336; H01Q 1/2225; H01Q 1/243; H01Q 7/08

USPC ..... 343/702, 893; 455/89, 90

See application file for complete search history.

(56) References Cited

U.S. PATENT DOCUMENTS

| | | | | |
|---|---|---|---|---|
| 5,138,328 | A * | 8/1992 | Zibrik | G06F 1/1616 343/702 |
| 6,011,517 | A * | 1/2000 | Skurski | H01Q 1/12 343/702 |
| 6,342,859 | B1 * | 1/2002 | Kurz | H01Q 1/242 343/700 MS |
| 6,348,894 | B1 * | 2/2002 | Lahti | H01Q 1/243 343/700 MS |
| 6,424,300 | B1 * | 7/2002 | Sanford | H01Q 1/243 343/700 MS |
| 6,531,985 | B1 * | 3/2003 | Jones | G06F 1/1616 343/700 MS |
| 6,545,643 | B1 * | 4/2003 | Sward | H01Q 1/10 343/700 MS |
| 2012/0038443 | A1 | 2/2012 | Kubo et al. | |

FOREIGN PATENT DOCUMENTS

CN 102738577 10/2012

* cited by examiner

*Primary Examiner* — Tho G Phan
(74) *Attorney, Agent, or Firm* — Jianq Chyun IP Office

(57) ABSTRACT

A near field communication module applied to an electronic device is provided. The near field communication module includes a flexible circuit board, a first sensing antenna and a second sensing antenna. The flexible circuit board includes a first part and a second part connected with each other. The first sensing antenna is disposed at the first part. The second sensing antenna is disposed at the second part. The first sensing antenna is connected to the second sensing antenna. After the flexible circuit board is bended, it is disposed at a side of the electronic device.

11 Claims, 7 Drawing Sheets

NEAR FIELD COMMUNICATION MODULE

CROSS-REFERENCE TO RELATED APPLICATION

This application claims the priority benefits of U.S. provisional application Ser. No. 61/817,300, filed on Apr. 29, 2013 and Taiwan application serial no. 103111527, filed on Mar. 27, 2014. The entirety of each of the above-mentioned patent applications is hereby incorporated by reference herein and made a part of this specification.

BACKGROUND OF THE INVENTION

1. Field of the Invention

The invention relates to a communication module and, more particularly to a near field communication module.

2. Description of the Related Art

Near field communication (NFC) is also called short distance wireless communication, it is a short distance high frequency wireless communication technology and developed from the non-contact radio frequency identification (RFID) and the interconnect technology. The near field communication technology allows two electronic devices to have a point-to-point connection by approaching or contacting each other, so as to transmit and exchange data.

With the multiple functions of NFC, such as easy to store, manage and transmit the data, if a consumer portable electronic product, such as a mobile phone, a watch, a camera, a portable game machine or a notebook computer, is integrated with the NFC, a variety of functions, such as the identification, the data exchange, the cost-per-action can be equipped, and the functionality of the electronic products is improved.

However, when the near field communication antenna is integrated to the electronic products, the high frequency harmonics generated by the near field communication antenna would be affected by the metal casing or other metal components of the electronic device, which reduces the recognition rate of the near field communication, or even leads the NFC antenna failure. To avoid the affection of the components, the position and the size for the near field communication antenna is limited, it is difficult to find an appropriate position where an antenna is not interfered. On the other hand, the near field communication antenna is usually disposed at one surface (such as the back cover) of the electronic product, which only provides one way wireless transmission and data exchange.

BRIEF SUMMARY OF THE INVENTION

A near field communication module applied to an electronic device is provided, which can achieve the wireless transmission and data exchange at two or more directions.

The near field communication module in the disclosure includes a flexible circuit board, a first sensing antenna and a second sensing antenna. The flexible circuit board includes a first part and a second part connected to each other. The first sensing antenna is disposed at the flexible circuit board and located at the first part. The second sensing antenna is disposed at the flexible circuit board and located at the second part. The first sensing antenna is connected to the second sensing antenna. After the flexible circuit board is bended, it is disposed at a side of the electronic device.

The near field communication module is disposed in a first housing or a second housing of the electronic device. After the flexible circuit board of the near field communication module is bended, the first sensing antenna and the second sensing antenna at the flexible circuit board are located at two opposite surfaces of the first housing or the second housing, respectively, and then magnetic lines generated by the first sensing antenna and the second sensing antenna emit towards two opposite directions, respectively. In other words, under the configuration, the two-way wireless transmission and data exchange can be achieved according to the magnetic field induction principle, so as to improve the convenience in operation.

BRIEF DESCRIPTION OF THE DRAWINGS

These and other features, aspects and advantages of the present invention will become better understood with regard to the following description, appended claims, and accompanying drawings

DETAILED DESCRIPTION OF THE EMBODIMENTS

Figure 1:
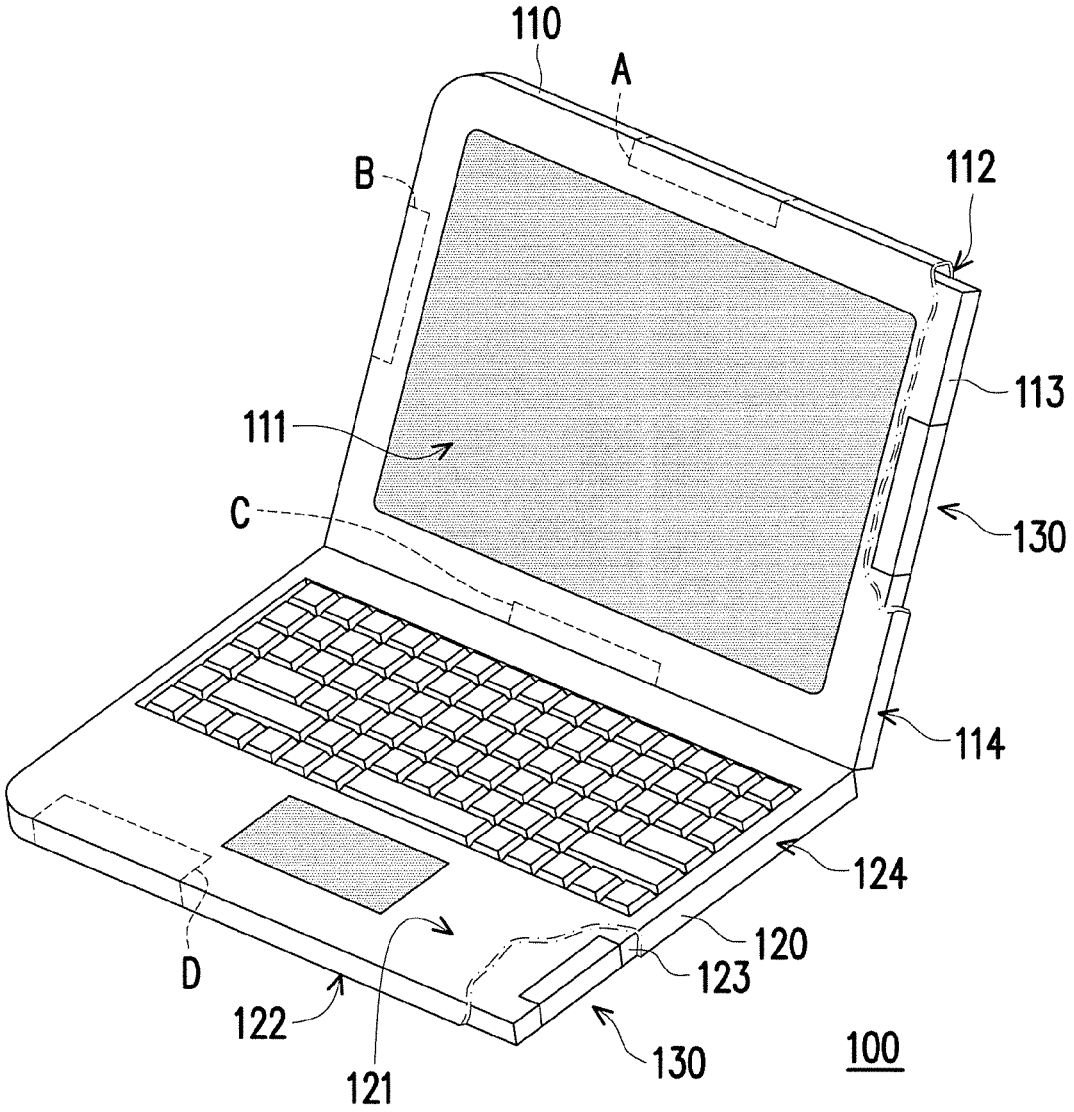
FIG. 1 is a schematic diagram showing a near field communication module applied to an electronic device in an embodiment.

FIG. 1 is a schematic diagram showing a near field communication module applied to an electronic device in an embodiment. Please refer to FIG. 1, in the embodiment, an electronic device 100 (such as a notebook computer) includes a first housing 110, a near field communication module 130 and a second housing 120 connected to the first housing 110. The first housing 110 may be a display module, and the second housing 120 may be a host of a notebook computer. The notebook computer can be closed via the relative rotation of the host and the display module for portability, if the user wants to use the notebook computer, the display module is unfolded for easy operation. The electronic device 100 also may be a tablet computer (that is the first housing 110), and the second housing 120 may be an expansion dock which can match and assemble with the tablet computer, which is not limited herein. Except for the physical electrically connection, the first housing 110 and the second housing 120 also be electrically connected via the wireless connection, which is not limited herein.

The first housing 110 includes a first surface 111 (such as the display surface) and a second surface 112 (such as the back surface) opposite to the first surface 111. The second housing 120 includes a third surface 121 (such as the surface which the keyboard is on) and a fourth surface 122 (such as the bottom surface) opposite to the third surface 121. The near field communication nodule 130 may be disposed at the first housing 110 or the second housing 120. In the embodiment, the near field communication module 130 is disposed at the first housing 110 or the second housing 120, respectively, which is not limited herein. In other embodiment, the near field communication module 130 also may be only disposed at one of the first housing 110 and the second housing 120.

Figure 2A:
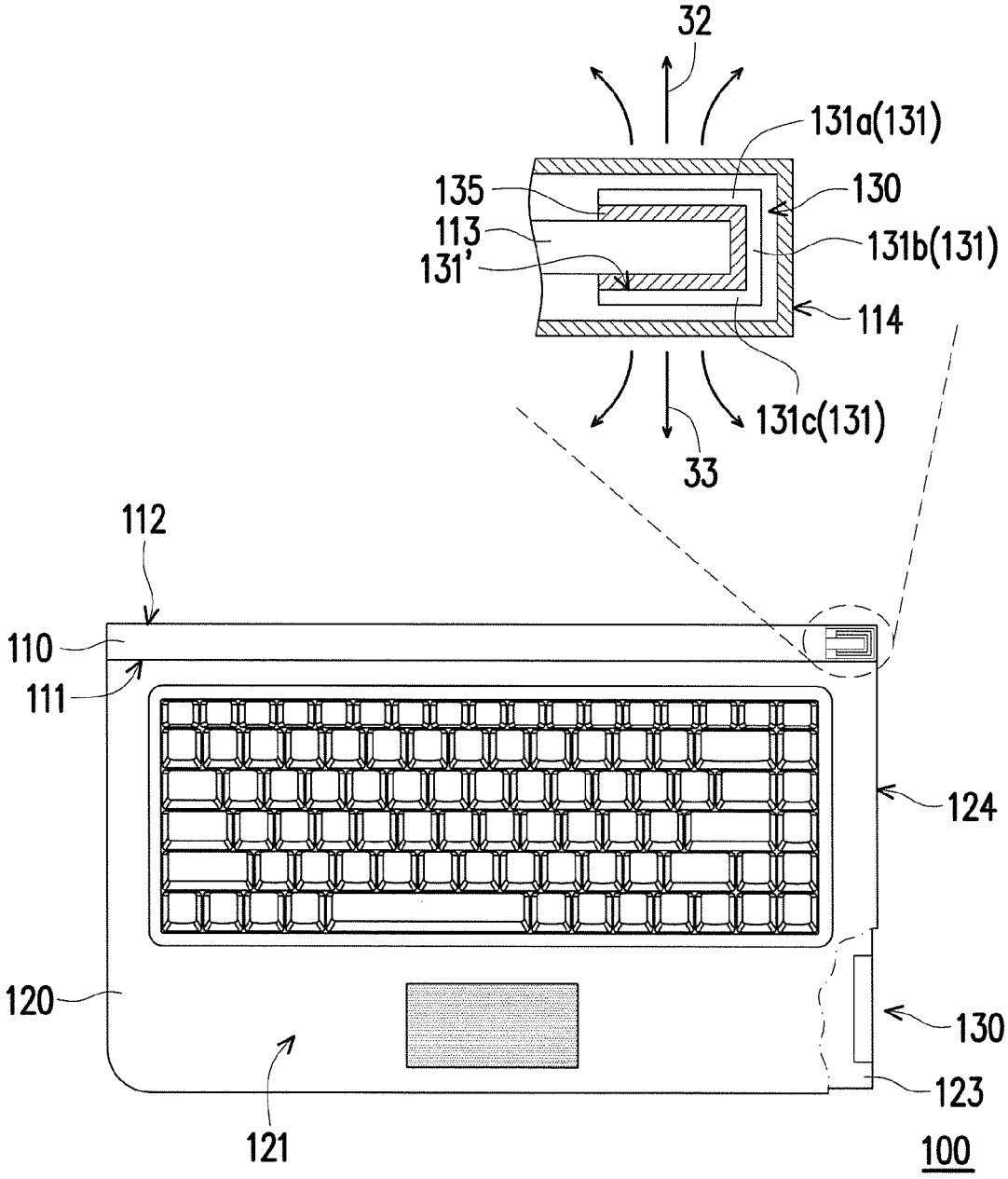
FIG. 2A is a top view showing the near field communication module applied to the electronic device in FIG. 1.
Figure 2B:
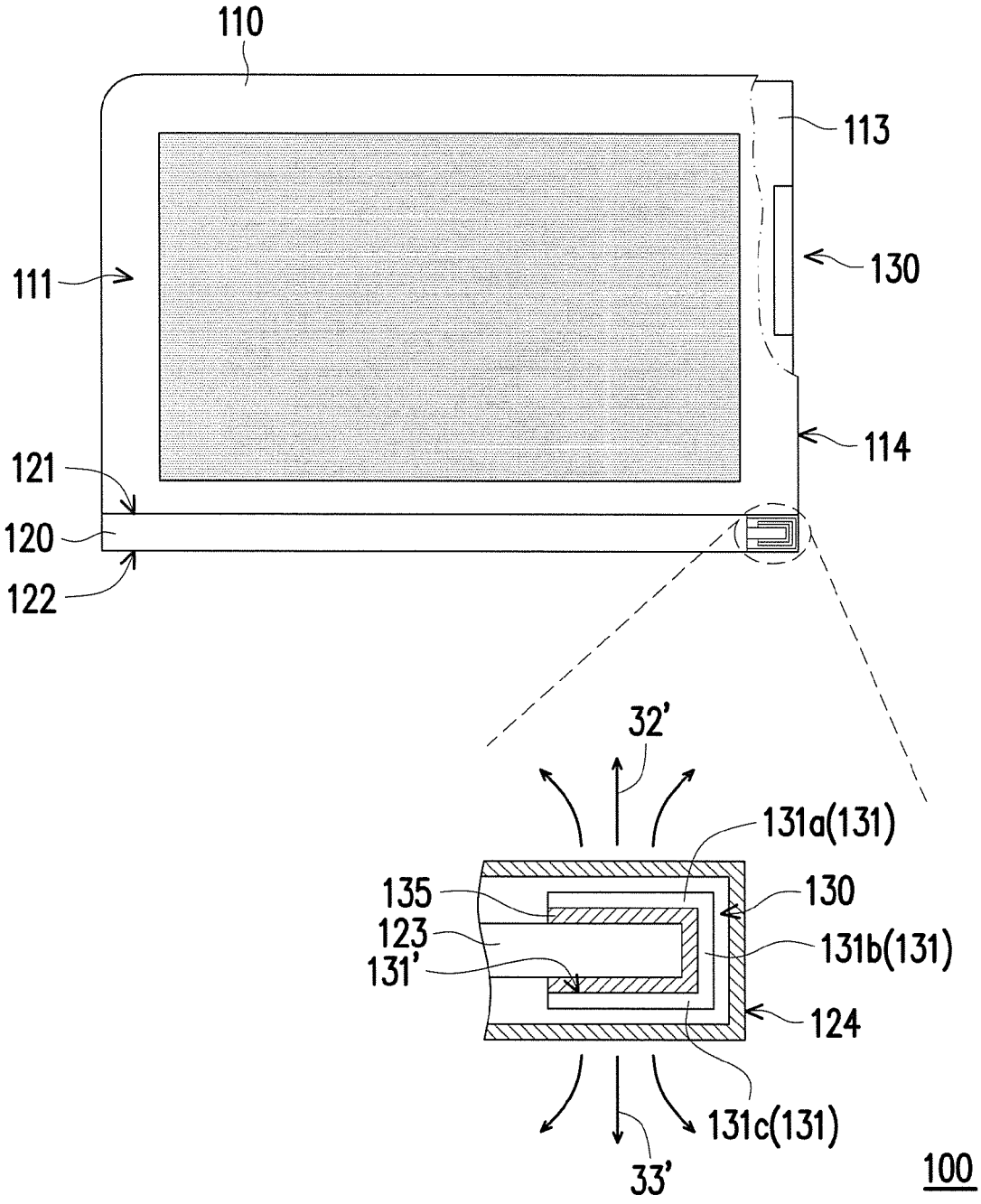
FIG. 2B is a front view showing the near field communication module applied to the electronic device in FIG. 1.
Figure 3:
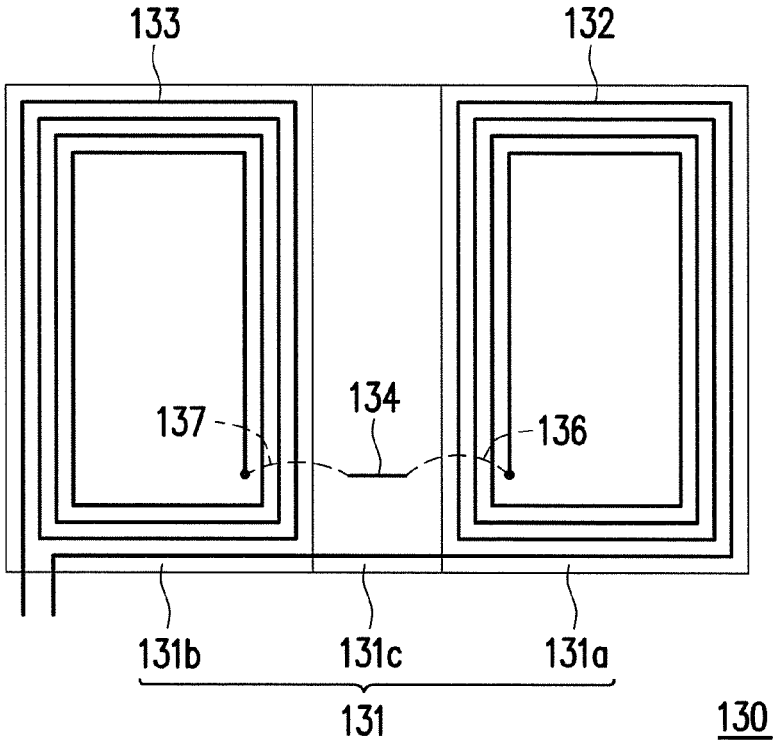
FIG. 3 is a schematic diagram showing the unfolded near field communication module in FIG. 1.

FIG. 2A is a top view showing the near field communication module applied to the electronic device in FIG. 1. FIG. 2B is a front view showing the near field communication module applied to the electronic device in FIG. 1. FIG. 3 is a schematic diagram showing the unfolded near field communication module in FIG. 1. Please refer to FIG. 2A, FIG. 2B and FIG. 3, the near field communication module 130 includes a flexible circuit board 131, a first sensing antenna 132 and a second sensing antenna 133. The flexible circuit board 131 is bendable, and it includes a first part 131*a* and a second part 131*c* which are connected to each other. In the embodiment, the area of the first part 131*a* of the flexible circuit board 131 is equal to that of the second part 131*c*, which is not limited herein.

The first sensing antenna 132 is disposed at the first part 131*a* of the flexible circuit board 131, and the second sensing antenna 133 is disposed at the second part 131*c* of the flexible circuit board. The first sensing antenna 132 and the second sensing antenna 133 are two loop antennas connected to each other, which are made of conductive metals, such as copper, aluminum, tin, gold or silver, which is not limited herein. In an embodiment, the flexible circuit board further includes a third part 131*b*, and the near field communication module 130 further includes a connecting wire 134. The third part 131*b* is connected to the first part 131*a* and the second part 131*c*, the connecting wire 134 crosses the third part 131*b* and is connected between the first sensing antenna 132 and the second sensing antenna 133.

After the flexible circuit board 131 is bended, it is disposed at the side 113 of the first housing 110 and the side 123 of the second housing 120, respectively. The first sensing antenna 132 is located at the second surface 112 of the first housing 110 and the third surface 121 of the second housing 120, respectively. The second sensing antenna 133 is located at the first surface 111 of the first housing 110 and the fourth surface 122 of the second housing 120, respectively. In that case, the third part 131*b* is located at the side wall 114 of the first housing 110 and the side wall 124 of the second housing 120, respectively. Thus, since the first sensing antenna 132 and the second sensing antenna 133 may be two loop antennas, after the current is induced to the first sensing antenna 132 and the second sensing antenna 133, the magnetic field is generated, respectively. The first sensing antenna 132 and the second sensing antenna 133 may surround the first part 131*a* and the second part 131*c* counterclockwise, respectively. Thus, magnetic lines 32 of the magnetic field around the first sensing antenna 132 (located at the second surface 112) emit through the second surface 112, magnetic lines 33 of the magnetic field around the first sensing antenna 133 (located at the first surface 111) emit through the first surface 111. The two emitting directions are opposite.

On the other hand, magnetic lines 32' of the magnetic field around the first sensing antenna 132 (located at the third surface 121) emit through the third surface 121, magnetic lines 33' of the magnetic field around the second sensing antenna 133 (located at the fourth surface 122) emit through the fourth surface 122. The two emitting directions are different. Under the configuration, when the electronic device 100 in the embodiment is operated, it can have two-way wireless transmission and data exchange with other electronic devices via one or both of the first sensing antenna 132 and the second sensing antenna 133, and thus the operation is more convenient.

For example, the using method of the near field communication function includes following steps: putting the card or the device with near field communication function on the first sensing antenna 132 or the second sensing antenna 133, and then coupling the antenna of the card with the magnetic field generated by the first sensing antenna 132 or the second sensing antenna 133, so as to achieve the wireless transmission and data exchange.

In the embodiment, the near field communication module 130 further includes a sheet 135 made of the ferrite or the electromagnetic shielding material. Conventionally, the sheet 135 is disposed at a surface 131' of the flexible circuit board 131 where the first sensing antenna 132 and the second sensing antenna 133 are not disposed at, for example, the sheet 135 completely cover the surface 131' of the flexible circuit board. That means, the sheet 135, and the first sensing antenna 132 and the second sensing antenna 133 are located at the opposite sides of the flexible circuit board 130, therefore, after the flexible circuit board 130 is bended, it can be disposed on the side 113 of the first housing 110 and the side 123 of the second housing 120 via the sheet 135, respectively. In that case, the sheet 135 can separate the first sensing antenna 132 and the second sensing antenna 133 from the electronic components, the metal components, and the side 113 of the first housing 110, and the sheet 135 can also separate the first sensing antenna 132 and the second sensing antenna 133 from the electronic components, the metal components, and the side 123 of the second housing 120, so as to block the effect of the above components on the magnetic field around the first sensing antenna 132 and the second sensing antenna 133, and then the reliability of the wireless transmission and data exchange is improved.

On the other hand, as to the connection of the first sensing antenna 132, the second sensing antenna 133 and the connecting wire 134, as shown in FIG. 3, the near field communication module 130 further includes a first bridge wire 136 and a second bridge wire 137. The first bridge wire 136 bridges over a part of the first sensing antenna 132 and is connected between the connecting wire 134 and the first sensing antenna 132. The second bridge wire 137 bridges over a part of the second sensing antenna 133 and is connected between the connecting wire 134 and the second sensing antenna 133. Thus, after the current is induced to the first sensing antenna 132 and the second sensing antenna 133, the current can flow through the first sensing antenna 132 and the second sensing antenna 133 smoothly, and the electrical interference is not easily generated.

The near field communication module 130 in FIG. 1 is just an example, in other embodiments, the near field communication module 130 also may be disposed at the area A, B, C or D of the FIG. 1 according to practical requirements, which is not limited herein. The wirings of the first sensing antenna 132 and the second sensing antenna 133 as shown in FIG. 3 are taken an example, which is not limited herein. In other words, the wirings of the first sensing antenna 132 and the second sensing antenna 133 can be adjusted according to the positions of the electronic components or the metal components of the first housing 110 and the second housing 120. That means, the wirings of the first sensing antenna 132 and the second sensing antenna 133 need to keep away from the electronic components or the metal components of the first housing 110 and the second housing 120, so as to avoid the electromagnetic interference.

Figure 4:
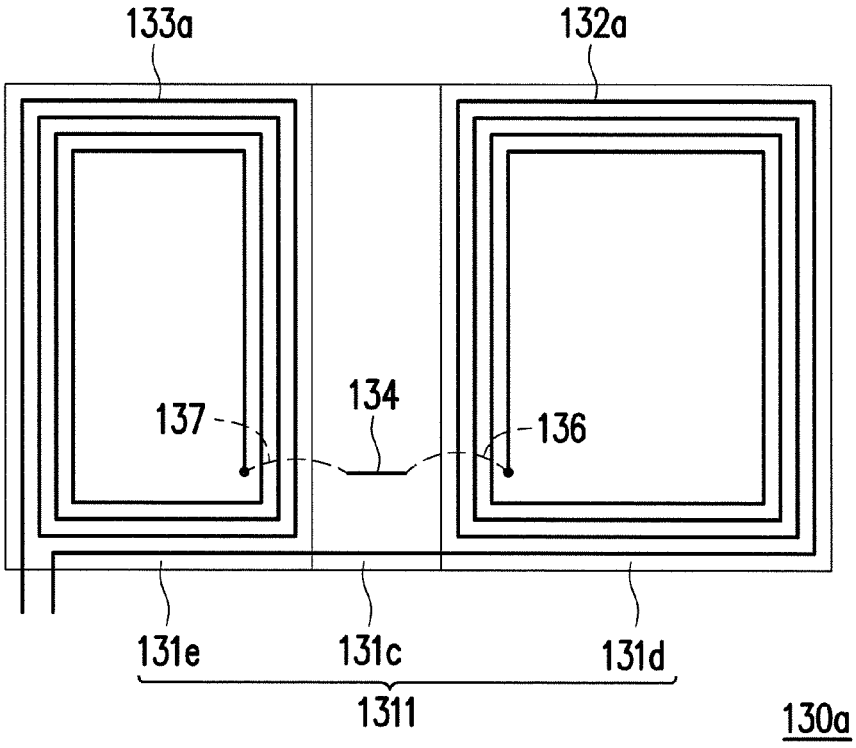
FIG. 4 is a schematic diagram showing an unfolded near field communication module in another embodiment.

FIG. 4 is a schematic diagram showing an unfolded near field communication module in another embodiment. Please refer to FIG. 4, in the embodiment, the difference between the near field communication module 130*a* and the near field communication module 130 in FIG. 3 is that the area of the first part 131*d* of the flexible circuit board 1311 of the near field communication module 130*a* is larger than the area of the second part 131*e*. Therefore, the surrounding area of the first sensing antenna 132*a* on the first part 131*d* is larger than that of the second sensing antenna 133*a* on the second part 131*e*. Thus, when the user disposes the card or the device with near field communication function on the first sensing antenna 132*a*, a larger sensing area is generated to couple with the magnetic field generated by the first sensing antenna 132*a*, so as to improve the convenience in operation.

Figure 5A:
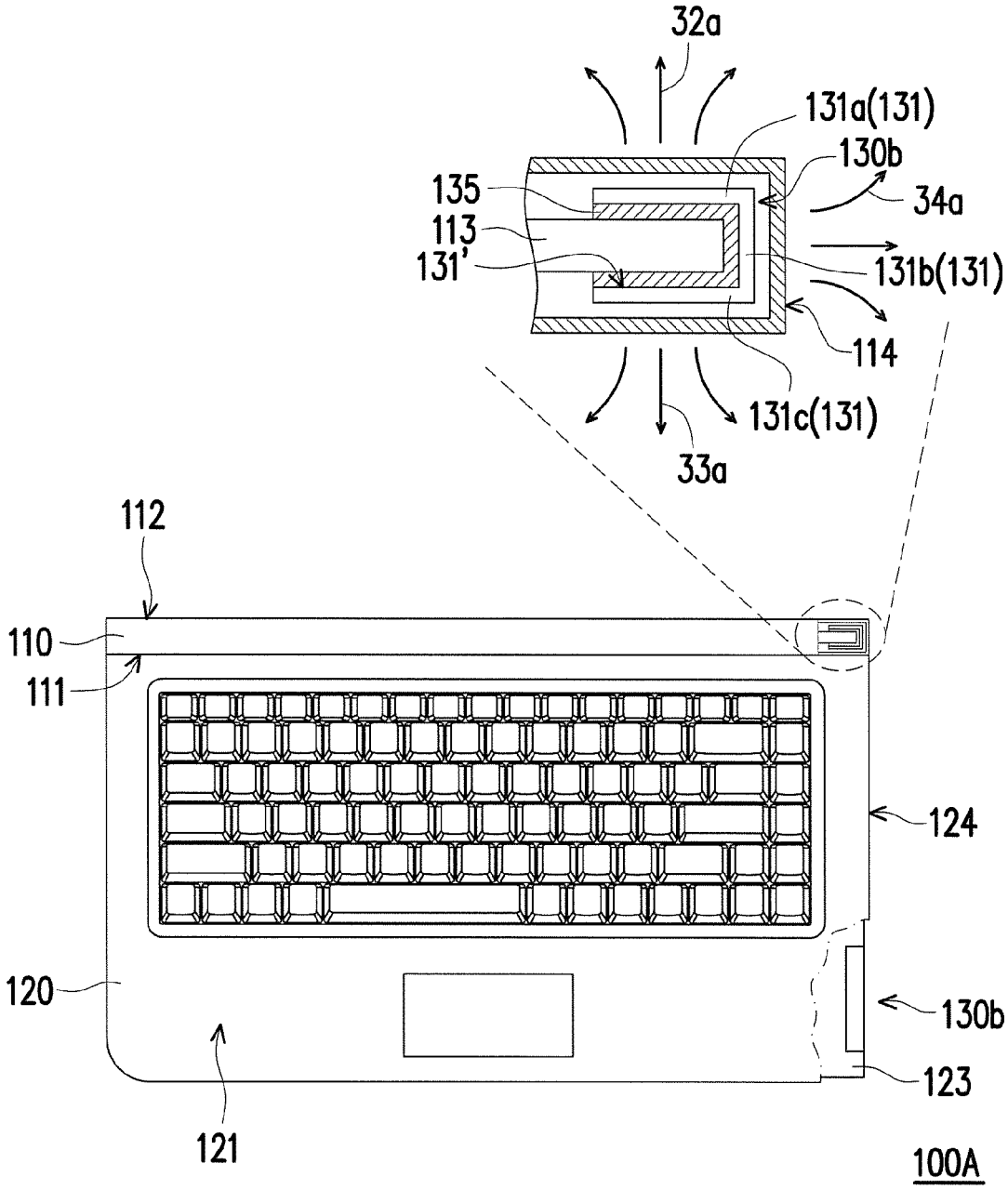
FIG. 5A and FIG. 5B are a top view and a front view showing a near field communication module applied to an electronic device in an embodiment.
Figure 5B:
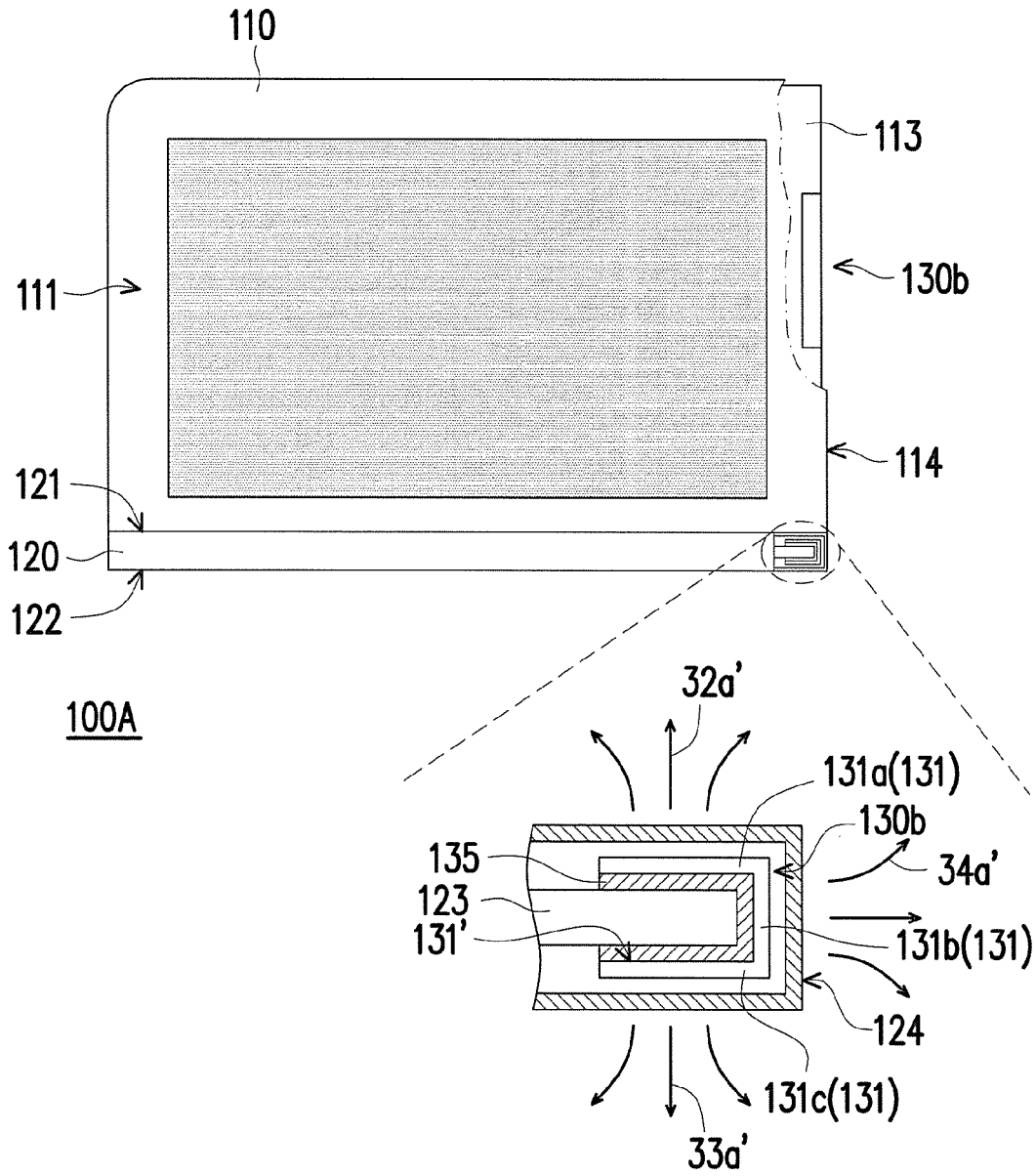
Figure 6:
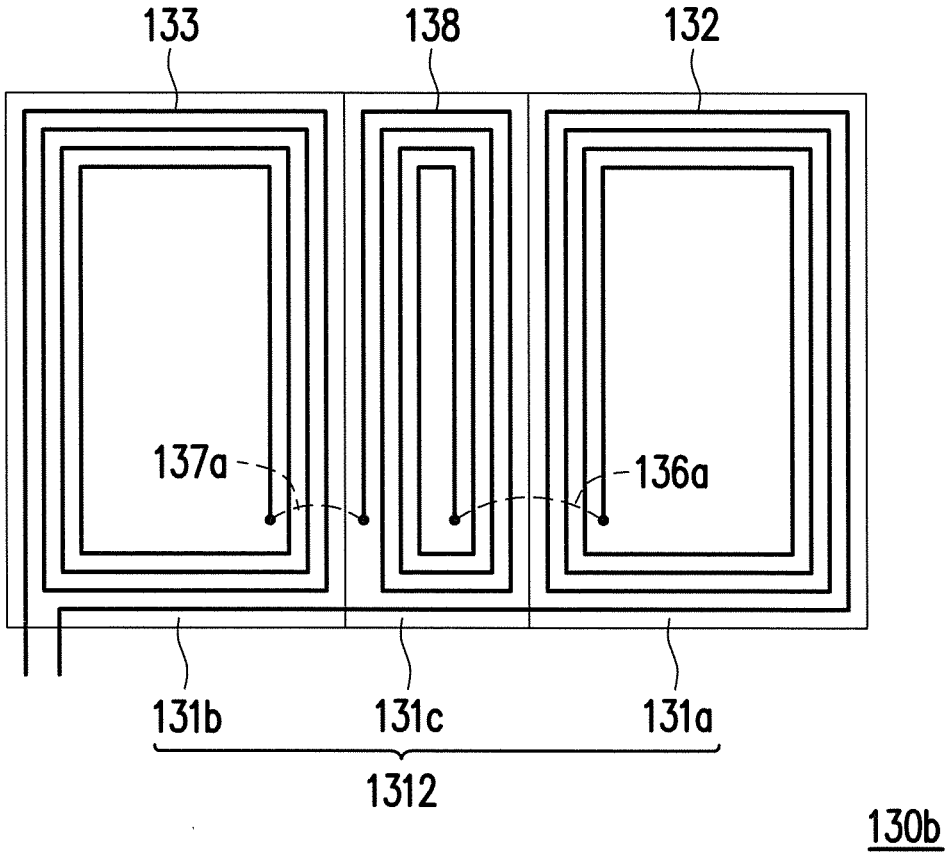
FIG. 6 is a schematic diagram showing the unfolded near field communication module in FIG. 5A and FIG. 5B.

FIG. 5A and FIG. 5B are a top view and a front view showing a near field communication module applied to an electronic device in an embodiment. FIG. 6 is a schematic diagram showing the unfolded near field communication module in FIG. 5A and FIG. 5B. Please refer to FIG. 5A, FIG. 5B and FIG. 6, different from the above embodiments, in the embodiment, the near field communication module 130*b* further includes a third sensing antenna 138. The third sensing antenna 138 may be a loop antenna made of conductive metals, such as copper, aluminum, tin, gold or silver, which is not limited herein. In detail, the third sensing antenna 138 is disposed at the flexible circuit board 1312 and located at the third part 131*b*. The third sensing antenna 138 is connected to the first sensing antenna 132 and the second sensing antenna 133, respectively.

Further, the third sensing antenna 138 may be connected to the first sensing antenna 132 via the first bridge wire 136*a*. The first bridge wire 136*a* bridges over a part of the first sensing antenna 132 and a part of the third sensing antenna 138, and it is connected between the third sensing antenna 138 and the first sensing antenna 132. The third sensing antenna 138 may be connected to the second sensing antenna 133 via the second bridge wire 137*a*. The second bridge wire 137*a* bridges over a part of the second sensing antenna 133, and it is connected between the third sensing antenna 138 and the second sensing antenna 133.

After the flexible circuit board 1312 is bended, the third sensing antenna 138 is located at the side wall 114 of the first housing 110 and the side wall 124 of the second housing 120, respectively. The first sensing antenna 132 is located at the second surface 112 and the third surface 121, respectively. The second sensing antenna 133 is located at the first surface 111 and the fourth surface 122, respectively. Since the first sensing antenna 132, the second sensing antenna 133 and the third sensing antenna 138 may be three loop antennas, the magnetic field is generated after the current is induced to the first sensing antenna 132, the second sensing antenna 133 and the third sensing antenna 138. The first sensing antenna 132, the second sensing antenna 133 and the third sensing antenna 138 may surround the first part 131*a*, the second part 131*c* and the third part 131*b* counterclockwise, respectively. Thus, the magnetic lines 32*a* of the magnetic field around the first sensing antenna 132 (located at the second surface 112) emit through the second surface 112, the magnetic lines 33*a* of the magnetic field around the second sensing antenna 133 (located at the first surface 111) emit through the first surface 111, the magnetic lines 34*a* of the magnetic field around the third sensing antenna 138 (located at the side wall 114) emit through the side wall 114, the three emitting directions are different.

The magnetic lines 32*a*' of the magnetic field around the first sensing antenna 132 (located at the third surface 121) emit through the first surface 121, the magnetic line 33*a*' of the magnetic field around the second sensing antenna 133 (located at the fourth surface 122) emit through the second surface 122, the magnetic lines 34*a*' of the magnetic field around the third sensing antenna 138 (located at the side wall 124) emit through the side wall 24, the three emitting directions are different. Under the configuration, when the electronic device 100A is operated in the embodiment, it can have three-way wireless transmission and data exchange with other electronic devices via one or all of the three sensing antennas, so as to improve the convenience in operation.

In detail, the wirings of the first sensing antenna 132, the second sensing antenna 133 and the third sensing antenna 138 should be adjusted according to the positions of the electronic components or the metal components of the first housing 110 and the second housing 120. That means, the wirings of the first sensing antenna 132, the second sensing antenna 133 and the third sensing antenna 138 need to keep away from the electronic components or the metal components of the first housing 110 and the second housing 120, so as to avoid the electromagnetic interference.

In conclusion, via the near field communication module disposed in the first housing or the second housing of the electronic device, and the first sensing antenna and the second sensing antenna of the flexible circuit board are respectively located at the opposite surfaces of the first housing or the second housing after the flexible circuit board of the near field communication module is bended, which makes the magnetic lines generated by the first sensing antenna and the second sensing antenna emit towards the two opposite directions, respectively. Or a third sensing antenna is further disposed between the first sensing antenna and the second sensing antenna, and thus after the flexible circuit board is bended, the first sensing antenna and the second sensing antenna are located at the opposite surfaces of the first housing or the second housing, and the third sensing antenna is located at the side wall between the two opposite surfaces, which makes the magnetic lines generated by the first sensing antenna, the second sensing antenna and the third sensing antenna emit towards the three different directions. In other words, under the above configuration, the wireless transmission and data exchange at two or more directions can be achieved according to the magnetic field induction principle, so as to improve the convenience in operation.

On the other hand, the sheet made of the ferrite or the electromagnetic shielding material is attached to the flexible circuit board, and thus it can block the affection of the electronic components or the metal components of the first housing and the second housing on the magnetic field around the first sensing antenna, the second sensing antenna and the third sensing antenna, so as to improve the reliability of the wireless transmission and the data exchange.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A near field communication module, applied to an electronic device comprising:

a flexible circuit board including a first part and a second part connected to each other;

a first sensing antenna disposed at the flexible circuit board and located at the first part; and a second sensing antenna disposed at the flexible circuit board and located at the second part, wherein the first sensing antenna is connected to the second sensing antenna and the first sensing antenna is disposed to overlap with the second sensing antenna, after the flexible circuit board is bended, the flexible circuit board is disposed on a side of the electronic device.

2. The near field communication module according to claim 1, wherein the electronic device includes:

a first housing; and a second housing electrically connected to the first housing, wherein the near field communication module is disposed at one of the first housing and the second housing.

3. The near field communication module according to claim 2, wherein the first housing includes a first surface and a second surface opposite to each other, the first sensing antenna is located at the second surface of the first housing, and the second sensing antenna is located at the first surface of the first housing.

4. The near field communication module according to claim 2, wherein the second housing includes a third surface and a fourth surface opposite to each other, the first sensing antenna is located at the third surface of the second housing, and the second sensing antenna is located at the fourth surface of the second housing.

5. The near field communication module according to claim 2, further comprising:

a sheet disposed at a surface of the flexible circuit board, wherein the sheet, and the first sensing antenna and the second sensing antenna are located at opposite sides of the flexible circuit board, after the flexible circuit board is bended, the flexible circuit board is disposed on the side of the first housing or the second housing via the sheet.

6. The near field communication module according to claim 2, wherein the flexible circuit board further includes a third part, the third part is connected to the first part and the second part, after the flexible circuit board is bended, the third part is located at a side wall of the first housing or the second housing.

7. The near field communication module according to claim 6, further comprising:

a connecting wire, wherein the connecting wire crosses the third part and is connected between the first sensing antenna and the second sensing antenna.

8. The near field communication module according to claim 7, further comprising:

a first bridge wire, wherein the first bridge wire bridges over a part of the first sensing antenna and is connected between the connecting wire and the first sensing antenna; and a second bridge wire, wherein the second bridge wire bridges over a part of the second sensing antenna and is connected between the connecting wire and the second sensing antenna.

9. The near field communication module according to claim 6, further comprising:

a third sensing antenna, wherein the third sensing antenna is disposed at the flexible circuit board and located at the third part, the third sensing antenna is connected to the first sensing antenna and the second sensing antenna, respectively, after the flexible circuit board is bended, the third sensing antenna is located at the side wall of the first housing or the second housing.

10. The near field communication module according to claim 9, further comprising:

a first bridge wire, wherein the first bridge wire bridges over a part of the first sensing antenna and a part of the third sensing antenna, and the first bridge wire is connected between the third sensing antenna and first sensing antenna; and a second bridge wire, wherein the second bridge wire bridges over a part of the second sensing antenna and connected between the connecting wire and the second sensing antenna.

11. The near field communication module according to claim 1, wherein the area of the first part of the flexible circuit board is larger than or equal to the area of the second part.

* * * * *